United States Patent [19]

Wasson

[11] Patent Number: 4,752,368

[45] Date of Patent: Jun. 21, 1988

[54] SYSTEM FOR PROTECTING METAL STRUCTURES AGAINST CORROSION

[76] Inventor: Loerwood C. Wasson, 8711 W. Beloit Rd., No. 431, West Allis, Wis. 53227

[21] Appl. No.: 17,278

[22] Filed: Feb. 20, 1987

[51] Int. Cl.[4] ..... C23F 13/00

[52] U.S. Cl. ..... 204/147; 204/196

[58] Field of Search ..... 204/196, 147

[56] References Cited

U.S. PATENT DOCUMENTS

| | | | |
|---|---|---|---|
| 1,558,647 | 10/1925 | Thalhofer | 204/147 |
| 1,576,581 | 3/1926 | Elmore et al. | 204/147 |
| 1,581,024 | 4/1926 | Shnetzer | 204/147 |
| 1,611,853 | 12/1926 | Creighton | 204/147 |
| 1,736,986 | 11/1929 | Thalhofer | 204/147 |
| 2,435,973 | 2/1948 | MacTaggart et al. | 204/147 |
| 2,986,512 | 5/1961 | Sabins | 204/147 |
| 3,425,921 | 2/1969 | Sudrabin | 204/147 |
| 3,859,588 | 1/1975 | Titus | 307/47 |

*Primary Examiner*—John F. Niebling
*Assistant Examiner*—Steven P. Marquis
*Attorney, Agent, or Firm*—Fred Wiviott

[57] ABSTRACT

A corrosion protection system comprises a circuit which includes rectifiers connecting the structure being protected to an alternating current source for producing negative current flow from the source to the device. An impedance is connected in circuit with the rectifier and the structure and a control is connected to the rectifier for applying a voltage thereto which controls the electron current flowing through the impedance to the structure.

18 Claims, 1 Drawing Sheet

SYSTEM FOR PROTECTING METAL STRUCTURES AGAINST CORROSION

This invention relates to corrosion protection for metal structures and particularly those which are in contact with electrolytes.

Metallic structures which are immersed in, carry or contact electrolytes, such as pipelines, boilers, pumps and the like, are subject to corrosion. Such corrosion results from the fact that metallic ions leave the surface of the metallic structure and enter the so called electrical "double layer" between the metallic structure and the electrolyte. Corrosion takes place when these metallic ions in the double layer combine with negative ions from the electrolyte which results in the release of the electrons and create a corrosion product. The surface at which this reaction occurs is called the anode. The electrons thus released migrate through a metallic path to a cathode whose location is dictated by the electrostatics of the structure. At the cathode, the electrons react with positive ions from the electrolyte. So long as this cycle of reactions continue, corrosion of the metallic structure will result.

One conventional corrosion protection practice is to immerse anodes in the electrolyte which is causing corrosion to the surface of the metallic structure being protected. Through the action of galvonic anodes, or through the use of electrical power sources and a rectifier action, electrons are withdrawn from the anodes and delivered to the structure being protected thereby withdrawing metallic ions from the electrical double layer, thereby preventing the corrosion process.

SUMMARY OF THE INVENTION

It is an object of the invention to provide a new and improved corrosion protection system.

A further object of the invention is to provide corrosion protection for elongate metallic structures, such as pipelines, storage tanks, pumps and the like.

Another object of the invention is to provide a corrosion protection which provides a controlled electron current flow from a conventional electric power distribution system to the structure being protected.

A still further object of the invention is to provide a corrosion protection systems for elongate metallic structures which is relatively inexpensive.

These and other objects and advantages of the present invention will become more apparent from the detailed description thereof taken with the accompanying drawings.

In general terms, the invention comprises a corrosion protection system consisting of circuit means including rectifying means connected to an alternating current electric power distribution system for producing negative current flow from the source to the protected structure. An impedance is connected in circuit with the rectifier means and the structure and a control is connected to the rectifer for applying a voltage thereto which controls the electron current through the impedance to the structure.

The system in accordance with the invention provides electrons to the protected equipment from a conventional power source without the need for the relatively expensive anode beds used in conventional protection systems. The electrons accumulate in the body of the protected structure to such an extent that they withdraw metallic ions from the electrical double layer, whereby corrosion is prevented.

DETAILED DESCRIPTION OF THE PREFERRED EMBODIMENTS

Figure 1:
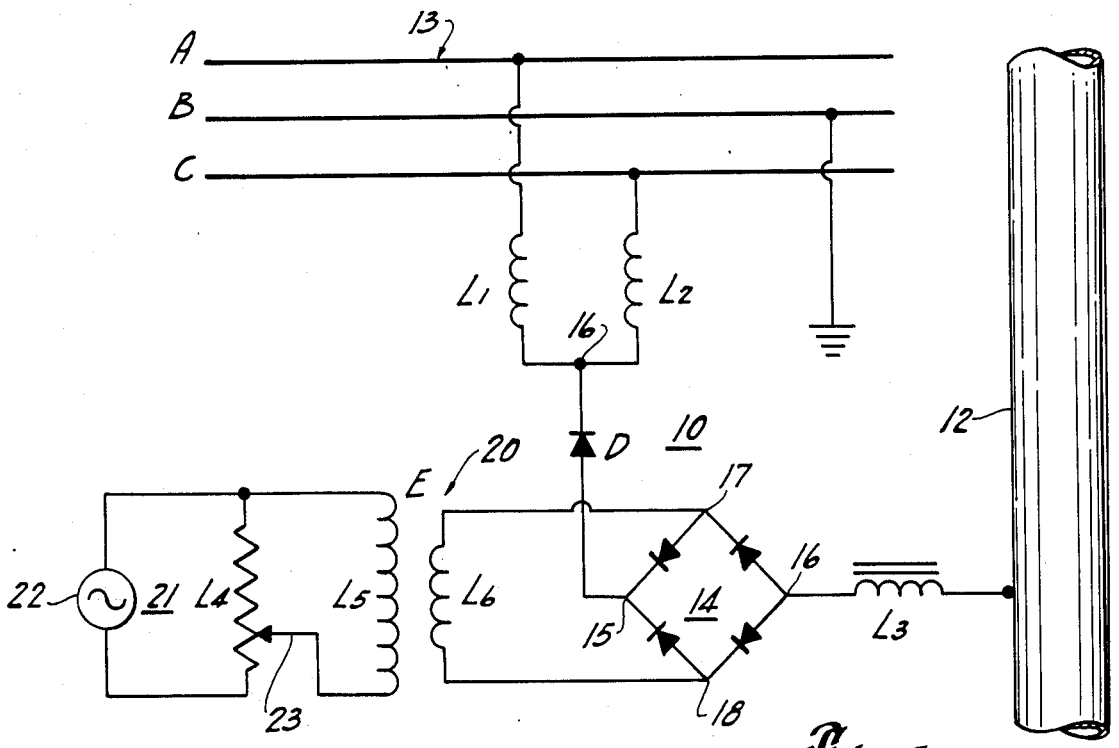
FIG. 1 schematically illustrates a preferred embodiment of the invention.

FIG. 1 shows a system 10 for minimizing corrosion of a metallic structure, such as pipe 12, which is in contact with an electrolyte. The system 10 is operable to provide an electron current flow to pipe 12 from a conventional alternating current power distribution system 13, which may, for example, comprise a 230 volt 3 wire system ABC. The voltages on wires A and C are balanced around the grounded neutral B.

The control 10 includes a full wave rectifier 14 having a first terminal 15 connected by a diode D to a common terminal 16 of a pair of matched inductors L1 and L2. The other ends of inductors L1 and L2 are respectively connected to conductors A and C, respectively, of the power supply system 13. In addition, terminal 16 of full wave rectifier 14 is connected to pipe 12 by a choke coil L3. The other terminals 17 and 18 of rectifier 14 are connected to an adjustable voltage source 20 consisting of an adjustable power supply 21 and a transformer E. Power supply 21 is schematically represented by a variable inductor L4 connected across an alternating current source 22. Transformer E includes a primary winding L5 connected across inductor L4 by means of an adjustable wiper 23. The secondary winding L6 of transformer E is connected to terminals 17 and 18 of rectifier 14.

As indicated previously, power supply 13 may consist, for example, of a 230 volt alternating current system which is balanced around the grounded neutral B. Such a system would be typical, for example, in a residential or small commercial building. The reactances of inductors L1 and L2 are sufficiently high that only a relatively small current flows through the reactors to junction 16 when they are the only active components of the system. However, inductors L1 and L2 will each have sufficient current-carrying capacity to handle a relatively large direct current. The diode D and the full wave rectifier 14 are connected in such a manner that electron flow will be permitted between junction 16, which is at virtual ground potential, through choke coil L3 to the pipe 12. In other words, when line A is negative, there will be a relatively low DC impedance path through inductor L1, rectifier D, bridge rectifier 14 and coil L3 to pipe 12. As a result, an electron current will flow from line A to pipe 12 in proportion to the voltage applied by the adjustable voltage source 20. Similarly, when line C becomes negative, an electron current will flow from it to the pipe 12 in a similar manner.

When the adjustable power supply 20 is set to deliver zero voltage, there will be an insignificant electron current flow from the junction 16 of coils L1 and L2 to pipe 12. However, when the upward voltage of supply 20 is increased, the voltage output of the bridge rectifier 14 will begin to withdraw electrons from junction 16 and deliver the same to the pipe 12.

Because the electrical conductivity of the pipe 12 is high with respect to the electrolyte contacting the structure, the electrons will distribute substantially uniformly throughout the metallic mass. As the level of these electrons increase in the metallic structure, the corrosion susceptible metallic ions are withdrawn from the electrical double layer where the protected metal contacts an electrolyte, either from the inside or the outside surface as in the case of a water pipe, for example. Corrosion will be arrested when all metallic ions are removed from the double layer.

Since the potential in lines A and C alternate through zero twice during each cycle, the delivery of electrons to pipe 10 will thus be cyclic. The choke coil L3 tends to minimize this effect by permitting the flow of DC current but blocking the cyclic component of the unidirectional current. As a result, a more nearly uniform directional current will be provided.

As indicated, the electron current flowing to pipe 12 will be present throughout those portions of which are in contact with the electrolyte. This will provide corrosion protection to the internal surface of the pipe as well as the outer surface. In addition, the electrons will become distributed throughout the pipe system thereby eliminating the necessity for a plurality of anode systems located at intervals along the pipe.

The invention prevents corrosion by providing a source of electrons which can accumulate at the surface of the structure being protected. The electron concentration withdraws metallic ions from the double layer of the contacting electrolyte which may be in contact with either surface of the metallic structure such as in the case of a pipe, for example, having different electrolytes in contact with each surface. Because the invention eliminates the necessity for buried anodes, it can provide corrosion protection metallic structures at a substantially reduced cost.

Figure 2:
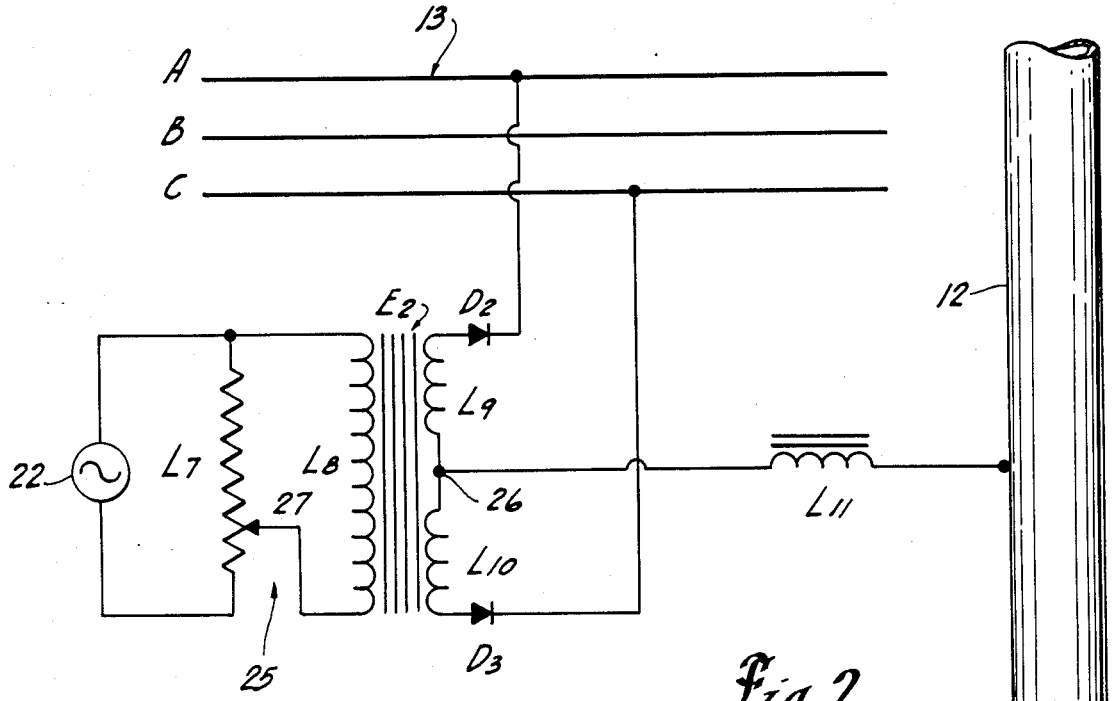
FIG. 2 shows an alternate embodiment of the present invention.

The alternate embodiment of the invention as shown in FIG. 2 to include an adjustable voltage source 25 schematically represented by an adjustable inductor L7 connected across an alternating current supply 22. In addition, there is a transformer E2, having a primary winding L8 connected across the adjustable slider of variable inductor L7. A center tap 26 divides the secondary winding of transformer E2 into coils L9 and L10. The other ends of coils L9 and L10 are respectively connected by diodes D2 and D3 to power supply conductors A and C. A choke coil L11 connects tap 26 to the pipe 12.

The tap 27 of inductor L7 is adjusted so that the voltages across secondary windings L9 and L10 will substantially buck the voltages which would otherwise appear across said windings as a result of the connections to the power system Lines A and C. This will cause a relatively small but adjustable negative voltage to appear at center tap 26 so that electron current will be drawn from the power supply system 13 for delivery to the pipe 12. The choke coil L11 will be chosen so as to present a high impedance to alternating current appearing at tap 26 but will present a minimum impedance to the DC component of the current. As a result, an adjustable controlled flow of electrons will be delivered to the structure being protected with a minimum of fluctuations.

While only a few embodiments of the invention have been illustrated and described, it is not intended to be limited thereby but only by the scope of the appended claims.

I claim:

1. A system for protecting from corrosion a metallic structure which is in contact with an electrolyte, the combination of:

circuit means including first and second balanced inductance means interconnected at one end to define a common terminal, said inductance means each being adapted to be connected at their other ends, respectively, to different conductors of an alternating current power supply for receiving electron current therefrom, control means connected to said circuit means for controlling the magnitude of the electron current and, rectifying means coupled to said first and second inductance means and oriented to permit the flow of electron current from said common terminal to the metallic structure, said electron current flowing from the common terminal.

2. The system set forth in claim 1 wherein said control means includes a variable transformer having at least one winding coupled to the inductance means for controlling the magnitude of the electron current.

3. The system set forth in claim 2 wherein said first and second inductance means are inductively coupled to the transformer winding for generating voltages opposed to those appearing on said inductance means from said power supply.

4. The system set forth in claim 3 and wherein said rectifying means comprises first and second rectifying means connected respectively between the one ends of said first and second inductance means and the conductors of the power supply, the common terminal of said inductance means being adapted to be connected to the metallic structure.

5. The system set forth in claim 4 and including a choke coil adapted to connect said common terminal to the metallic structure.

6. The system set forth in claim 2 wherein said rectifying means is connected to the common terminal of the inductance means and the metallic structure being protected, said rectifying means being adapted to connect said terminal to the structure being protected.

7. The system set forth in claim 5 wherein said transformer is connected to said rectifying means.

8. The system set forth in claim 6 wherein said rectifying means includes a bridge rectifier and an additional rectifier connecting one terminal of the bridge rectifier to the common terminal, the second terminal of said bridge rectifier being connected to the metallic structure, said transformer comprising a varible transformer having a secondary winding connected to the other terminals of the bridge rectifier.

9. The apparatus set forth in claim 8 and including a choke coil connected to the second terminal of the bridge rectifier and being adapted to be connected to the metallic structure being protected.

10. A method of preventing corrosion in metallic apparatus in contact with an electrolyte, the steps of: connecting a pair of inductors to different conductors of an alternating current power supply, rectifying the current flow in each of said inductors so that an electron current flows alternately in said inductors and in a direction away from the conductors of said alternating current power supply, applying a voltage to said inductors in an opposed relation to the voltage thereacross resulting from the connection to the alternating current power system for controlling the magnitude of said electron current, and conducting the controlled electron current to the apparatus being protected.

11. The method set forth in claim 10 and including the step of blocking the variable component of the electron current.

12. A system for protecting from corrosion a metallic structure which is in contact with an electrolyte, the combination of:

circuit means including first and second inductors, each inductor being adapted to be connected to a different conductor of an alternating current power supply for withdrawing an electron current therefrom, rectifying means coupled to said inductors and oriented to permit the flow of unidirectional electron current from said inductors to said metallic structure, control means coupled to the inductors for controlling the magnitude of the electron current flowing therefrom so that a controlled electron current flows alternatingly through said inductors and said rectifying means and to said metallic structure.

13. The system set forth in claim 12 wherein said inductors are balanced and each is connected at one end to said alternating current power supply, said rectifying means being connected in circuit with said inductors and oriented to permit the electron current to flow alternately in said inductors as the current in said alternating current power supply alternates.

14. The system set forth in claim 13 wherein the other ends of said inductors are interconnected, said rectifing means being connected to the interconnection of said inductors whereby said electron current flows therefrom.

15. The system set forth in claim 14 wherein said rectifying means comprises first and second rectifiers connected respectively between the one ends of the first and second inductors and the conductors of the power supply, the interconnection of said inductors being connected to the metallic apparatus.

16. The system set forth in claim 15 and including a choke coil connected between the interconnection of said inductors to the metallic structure.

17. The system set forth in claim 16 wherein the rectifier means is connected between the interconnection of said inductors and the metallic structure being protected.

18. The system set forth in claim 17 and including a choke coil connected between the interconnection of said inductors and the metallic structure being protected.

* * * * *